US006596447B2

(12) United States Patent
Camp et al.

(10) Patent No.: US 6,596,447 B2
(45) Date of Patent: Jul. 22, 2003

(54) PHOTOGRAPHIC ELEMENT WITH NACREOUS OVERCOAT

(75) Inventors: Alphonse D. Camp, Rochester, NY (US); Peter T. Aylward, Hilton, NY (US); Robert P. Bourdelais, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/931,334

(22) Filed: Aug. 16, 2001

(65) Prior Publication Data

US 2003/0039904 A1 Feb. 27, 2003

(51) Int. Cl.[7] ..... G03C 1/95; G03C 1/765; G03C 11/08; B41J 3/407

(52) U.S. Cl. ..... 430/11; 430/14; 430/220; 430/432; 430/510; 430/523; 430/533; 430/536; 430/961; 347/106

(58) Field of Search ..... 430/11, 14, 533, 430/523, 536, 510, 961, 432, 220; 347/106

(56) References Cited

U.S. PATENT DOCUMENTS

| | | | | | |
|---|---|---|---|---|---|
| 4,216,018 | A | | 8/1980 | Bilofsky et al. | 430/220 |
| 4,269,916 | A | | 5/1981 | Bilofsky et al. | 430/220 |
| 4,288,524 | A | | 9/1981 | Bilofsky et al. | 430/220 |
| 4,457,540 | A | * | 7/1984 | Hohne | 430/11 |
| 5,340,692 | A | | 8/1994 | Vermeulen et al. | 430/233 |
| 5,466,519 | A | | 11/1995 | Shirakura et al. | 430/538 |
| 5,733,658 | A | | 3/1998 | Schmid et al. | |
| 5,858,078 | A | | 1/1999 | Andes et al. | |
| 5,866,282 | A | | 2/1999 | Bourdelais et al. | 430/536 |
| 5,888,681 | A | | 3/1999 | Gula et al. | 430/536 |
| 6,030,759 | A | | 2/2000 | Gula et al. | 430/536 |
| 6,071,654 | A | | 6/2000 | Camp et al. | 430/536 |
| 6,071,680 | A | | 6/2000 | Bourdelais et al. | 430/536 |
| 6,274,282 | B1 | | 8/2001 | Aylward et al. | 430/536 |

* cited by examiner

*Primary Examiner*—Richard L. Schilling
(74) *Attorney, Agent, or Firm*—Paul A. Leipold

(57) ABSTRACT

This invention relates to a photographic element comprising at least one layer comprising nacreous pigment above the image.

30 Claims, No Drawings

PHOTOGRAPHIC ELEMENT WITH NACREOUS OVERCOAT

FIELD OF THE INVENTION

This invention relates to imaging materials. In a preferred form, it relates to nacreous photographic reflective paper.

BACKGROUND OF THE INVENTION

In reflective photographic papers there is a need to protect the imaging layers from scratches, fingerprints, and stains. Current photographic reflective papers use a gelatin overcoat to protect the imaging layers. While the gelatin does provide some level of protection, it can easily be scratched reducing the quality of the image. Further, fingerprints or stains caused by common household liquids such as coffee, water, or fruit juice can easily stain and distort images. Wiping the images while wet causes undesirable distortion to the gelatin overcoat. Post photographic processing equipment exists that provides a protective coating to the imaging layers. Typically consumer images are individually coated or laminated with a polymer to provide protection to the image layers. A common example is photographic identification badges which are typically laminated with a clear polymer sheet to provide protection to the image on the identification badge. Post processing application of a protective layer is expensive, as it requires an additional step in the preparation of the reflective print and additional materials to provide the overcoat. It would be desirable if a reflective photographic image could be formed with a protective coating over the developed image layers that could be efficiently applied.

It is also well know in the art of imaging to provide a protective over-lamination of the imaging element. This is commonly practiced in the industry. Typically this is a clear polymer sheet with either a pressure sensitive or heat activated adhesive that is applied in a post image formation application. The clear polymer sheet may be polyolefins, polyester or polycarbonate sheet. These sheets may even in textured. There have also been numerous attempts to apply liquid polymer over coats to the image to protect them from damage and handling abuses. There remains a need to provide an over protective layer that not only provides protection to the image but further enhances its value by provide a nacreous appearance to the image.

Prior art reflective imaging output materials such as silver halide reflective images or inkjet reflective images typically comprise imaging layers applied to a white reflective base material. The white reflective base reflects ambient light back to the observer's eye to form the image in the brain. Prior art base materials typically utilize white reflecting pigments such as $TiO_2$ or barium sulfate in a polymer matrix to form a white reflective base material. Prior art reflective photographic papers also contain white pigments in the support just below the silver halide imaging layers to obtain image whiteness and sharpness during image exposure, as the white pigment reduces the amount exposure light energy scattered by the cellulose paper core. Details on the use of white pigments in highly loaded coextruded layers to obtain silver halide image sharpness and whiteness are recorded in U.S. Pat. No. 5,466,519.

It has been proposed in U.S. Pat. No. 6,071,680 (Bourdelais et al) to utilize a voided polyester sheet coated with light sensitive silver halide imaging layers for use as photographic output material. The voided layer in U.S. Pat. No. 6,071,680 improves opacity, image lightness, and image brightness compared to prior art polyethylene melt extrusion coated cellulose paper base materials. The image base proposed in U.S. Pat. No. 6,071,680 also contains an integral polyolefin skin layer to facilitate imaging layer adhesion at the time of manufacture and during the processing of silver halide imaging layers.

It has been proposed in U.S. Pat. No. 5,866,282 (Bourdelais et al) to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments such as $TiO_2$ above and below the microvoided layer. The composite imaging support structure described in U.S. Pat. No. 5,866,282 has been found to be more durable, sharper and brighter than prior art photographic paper imaging supports that use cast melt extruded polyethylene layers coated on cellulose paper.

There, however, remains a continuing need for improvements to the appearance of imaging output materials. It has been shown that consumers, in addition to reflective output material, also prefer nacreous images. Nacreous images exhibit a pearly or nacreous luster, an iridescent play of colors, and a brilliant luster that appears in three dimensions. Nacreous appearance can be found in nature if one examines a pearl or the polished shell of *Turbo marmoratus*.

A nacreous photographic element with a microvoided sheet of opalescence is described in U.S. Pat. No. 5,888,681 (Gula et al). In U.S. Pat. No. 5,888,681 microvoided polymer sheets with microvoided polymer layer located between a cellulose paper base and developed silver halide imaging provide an image with an opalescence appearance. The nacreous appearance is created in U.S. Pat. No. 5,888,681 by providing multiple internal reflections in the voided layer of the polymer sheet. While the opalescence appearance is present in the image, the image suffers from a loss of image sharpness or acutance, a higher density minimum position, and a decrease in printing speed compared to a typical photographic image formed on a white, reflecting base. It would be desirable if the opalescent look of the image could be maintained while improving printing speed, increasing sharpness, and decreasing density minimum. Also, while the voided polymer does provide an excellent nacreous image, the voided layer, because it is pre-fractured, is subjected to permanent deformation, thus reducing the quality of the image.

Nacreous pigments added to a matrix, such as paint or plastic, have been known to exhibit a nacreous appearance. The prior art use of the nacreous pigments have been for pigmenting paints, printing inks, plastics, cosmetics, and glazes for ceramics and glass. Nacreous pigments are dispersed in a matrix and then painted or printed onto a substrate. Pearl luster pigments containing titanium dioxide have been successfully employed for many years. They are constructed in accordance with the layer substrate principle, with mica being employed virtually without exception as substrate.

Mica pigments are used widely in the printing and coating industries, in cosmetology, and in polymer processing. They are distinguished by interference colors and a high luster. For the formation of extremely thin layers, however, mica pigments are not suitable, since the mica itself, as a substrate for the metal-oxide layers of the pigment, has a thickness of from 200 to 1200 nanometer. A further disadvantage is that the thickness of the mica platelets within a certain fraction defined by the platelet size in some cases varies markedly about a mean value. Moreover, mica is a naturally occurring mineral that is contaminated by foreign ions. Furthermore, technically highly complex and time-consuming processing steps are required including, in particular processing steps are required including, in particular, grinding and classifying.

Pearl luster pigments based on thick mica platelets and coated with metal oxides have, owing to the thickness of the edge, a marked scatter fraction, especially in the case of relatively fine particle-size distributions below 20 micrometers. As a substitute for mica, it has been proposed to use thin glass flakes that are obtained by rolling a glass melt with subsequent grinding. Indeed, interference pigments based on such materials exhibit color effects superior to those of conventional, mica-based pigments. Disadvantages, however, are that the glass flakes have a very large mean thickness of about 10–15 micrometers and a very broad thickness distribution (typically between 4 and 20 micrometers), whereas the thickness of interference pigments is typically not more than 3 micrometers.

In U.S. Pat. No. 5,340,692 (Vermeulen et al) an imaging receiving material with nacreous pigment for producing contone images according to the silver salt diffusion process is disclosed. According to the process disclosed in U.S. Pat. No. 5,340,692, contone images with an antique look can be obtained utilizing the silver salt diffusion transfer process without the need of special processing liquids using a nacreous pigment in the imaging receiving layer or located between the support and the image receiving layer. The silver halide imaging layers used are created with retained silver and, therefore, are not semitransparent. Because the nacreous pigments used are contained in the imaging receiving layer and not silver halide imaging layer, the image form will not have a uniform nacreous appearance, as the density of the transferred silver halide image block the multiple reflections from the nacreous pigments. Further, the nacreous pigments utilized are too large and in too great a concentration to be included in the silver halide imaging layer as a rough surface would result, reducing the desired nacreous appearance of the image. The gold flakes used in the example in U.S. Pat. No. 5,340,692 are an attempt to simulate prior art black-and-white photographic "Sepatone" appearance produced during a post process treatment of the imaging layers. While the image in the example does have an antique appearance, the image does not have a nacreous appearance.

In U.S. Pat. No. 4,269,916 (Bilofsky et al) and related patents U.S. Pat. Nos. 4,288,524 and 4,216,018, instant photographic products having reflective layers which comprise lemellar interference pigments are disclosed. The intended use of the lemellar pigments is to create a pleasing white reflective appearance for the base material without the need for blue tints. It has been proposed that flat particles of metal oxides created by coating salts with metal oxides and later dissolving the salts leaving a thin flake of metal oxide as a substitute for spherical $TiO_2$ particles. Titanium dioxide particles typically are utilized in photographic art to create a white reflective surface for the viewing of print materials. The intent of U.S. Pat. No. 4,269,916 is to provide a white reflecting surface that does not have an angular viewing appearance and a consistent L*, thus the invention materials do not exhibit a nacreous appearance. Examples in U.S. Pat. No. 4,269,916 show high reflectivity at a variety of collection angles which is opposite of a nacreous appearance where reflectivity changes as a function of collection angle. Further, the lemellar pigments are not present in the silver halide imaging layers or in the base materials used in the invention.

In U.S. Pat. No. 5,858,078 (Andes et al), a process for the production platelet like, substrate free $TiO_2$ pigment is disclosed for use in printing inks, plastics, cosmetics and foodstuffs is.

In U.S. Pat. No. 5,733,658 (Schmid et al) luster pigments obtainable by treating titania coated silicate based platelets from 400° C. to 900° C. with a gas mixture comprising a vaporized organic compound and ammonia are described as useful for coloring paints, inks, plastics, glasses, ceramic products, and decorative cosmetic preparations.

When imaging supports are subject to variations in ambient conditions over long periods of time, the image-containing layers and resin layers tend to deteriorate into a mass of cracks which are aesthetically undesirable and which, in extreme cases, extend over the entire print completely destroying the image. All polymers are inherently prone to chemical degradation that leads to loss of mechanical properties. They undergo thermal degradation during processing such as extrusion of thin films, and photooxidative degradation with long-term exposure to light. The $TiO_2$ utilized in U.S. Pat. Nos. 5,858,078 and 5,733,658 catalyzes and accelerates both thermal and photooxidative degradation In the art of resin coating imaging papers, the melt polymers are extruded at high temperatures and are also subjected to high shear forces. These conditions may degrade the polymer, resulting in discoloration and charring, formation of polymer slugs or "gels", and formation of lines and streaks in the extruded film from degraded material deposits on die surfaces. Also, thermally degraded polymer is less robust than non-degraded polymer for long-term stability, and may thereby shorten the life of the print.

It has been shown that when imaging layers (silver halide, ink jet, flexography, laser toner, and the like) are applied to nacreous base materials, the nacreous appearance of the image is optimized when the image forming layers contain semitransparent dyes. The use of pigmented inks and dyes in the imaging layers tend to reduce the nacreous appearance of the image. In U.S. Pat. No. 6,071,654 (Camp et al) silver halide imaging layers that are semitransparent are coated on a nacreous support containing a voided polymer layer. The voided polymer layers create flat platelets oriented parallel to each other. The reflection which reaches the eye is primarily specular. It arises in depth, since each transparent polymer platelet reflects some of the incident light and reflects the remainder. The images in U.S. Pat. No. 6,071,654 exhibit a nacreous appearance.

Prior art in the formation of nacreous images has been limited to specialized base substrates that have unique polymer reflecting layer or in the field of printing to the use of nacreous pigments in printing inks. All these methods require the development or treatment of the substrate material. There remains a need for a means of obtaining a nacreous appearance without the use of a specialized substrate.

PROBLEM TO BE SOLVED BY THE INVENTION

There is a need for a reflective imaging material that provides a nacreous or pearlescent appearance without having to have a special base while, at the same time, maintains sharpness or viewing pleasure.

SUMMARY OF THE INVENTION

It is an object of the invention to provide improved photographic materials.

It is another object to improved image appearance compared to prior art nacreous photographic materials.

It is a further object to provide photographic materials that have a nacreous appearance independent of the base material.

These and other objects of the invention are accomplished by a photographic element comprising at least one layer comprising nacreous pigment above the image.

ADVANTAGEOUS EFFECT OF THE INVENTION

The invention provides unique nacreous images that are brighter, have snap and sparkle while having good photographic sharpness and exposure speed. Further the images have a desirable nacreous appearance that does not require a special base. Additional the image is protected from environmental abuses.

DETAILED DESCRIPTION OF THE INVENTION

The invention has numerous advantages over prior art photographic reflective materials. The reflective materials of the invention provide an image with a nacreous appearance while maintaining efficient reflection of light, sharpness, and photographic speed. Maintaining image sharpness and whiteness is important, as consumers expect silver halide images to be high in quality. Further, maintaining printing speed is critical for efficient photographic processing, as a significant loss in printer speed could increase the cost of consumer silver halide images. Being able to apply the nacreous appearance to an image independently of the image formation provides tremendous flexibility and helps to eliminate a number of potential problems in the formation of the image. Since nacreous pigments are being used above the image and are applied to the image after the formation of the image, there is less light scattering that will interfere with the photographic image formation. Furthermore the materials that are suitable for this invention provide protection to the image. Image formation by inkjet, thermal dye sublimation and electrophotographic is not achieved optically and therefore are not subjected to the same light scattering issues as photographic images but these and other imaging technologies may utilize the nacreous pigment overlamination or overcoating to enhance the image message. Whatever means is used to achieve the nacreous effect above the image, the amount of light scattering needs to be optimized for the desired nacreous effect while maintaining acceptable clarity of the image.

The nacreous imaging materials of the invention provide an eye-catching appearance that make them particularly desirable in imaging applications that require capturing the attention of the consumer. One example includes display materials that are intended to communicate an advertising message to people in a public setting such as a bus stop, train station, or airport. The nacreous images are differentiated in look from prior art materials and, thus, provide the pop and sizzle that can catch the consumer's attention or they may be toned down to create a soft iridescence mood that is also very effective in capturing the attention of the consumer. By providing the nacreous image with a pressure sensitive adhesive, the tough, durable nacreous image can be applied to various surfaces, which is particularly desirable for the youth market.

Photographic nacreous labels of the invention utilized in packaging markets enable a differentiated look and consumer appeal on store shelf. The utilization of the thin, flexible, and tough silver halide materials results in a packaging material having many superior properties. The packaging materials of the invention have a depth of image unsurpassed by existing packaging materials. The packaging materials of the invention may be utilized with a variety of packaging materials that are suitable pressure sensitive labeling, such as shampoo bottles, perfume bottles, and film boxes. The packaging materials of the invention, while having the advantage of superior image, are available on thin base materials which are low in cost while providing superior opacity and strength. The packaging materials of the invention, as they may be imaged by flash optical exposure or digital printing, have the ability to be formed in short runs and to be rapidly switched from one image to the next without delay.

The term "nacreous" refers to a pearly, luster, and nacreous appearance. This may include a metallic, lustrous, and somewhat iridescent effect. The nacreous effect is the result of interference pigments that are platelet-like in their structure. Typically these are elongated platelet-like structures of silicate-based materials such as metal oxide coated mica, feldspar, and quartz. These pigments tend to cause specular and diffuse reflection, and they also transmit some light. The use of nacreous pigments in the paint and printing industry are typically designed to create a variety of eye-popping colors. These materials are typically coated over dark black backgrounds to help accentuate the eye-popping optical effects. Special metal oxide coatings are applied to mica particles in very thin layers. This allows for some light to be refracted, while other light will transmit through to the near transparent layers of the mica particle to be refracted at a slightly different angle. Since these pigments are suspended in a binder polymer of yet another refractive index, there are multiple light refractions that create a lustrous appearance. In addition, the chemistry of the coating that is applied to the mica particles may be varied to create various colors. Metal oxide coatings that may be used in an embodiment of this invention include titanium, iron, chromium, barium, aluminum, zinc, zirconium, bismuth vanadate, nickel titanate, chromium titanate, lead, and others. While these produce some exciting colors in the field of photography and imaging, traditional print materials have a white background. Additionally, it should be noted that the thickness of the metal oxide coating on the mica may also impact the color. Useful metal oxide coating on the mica particles may comprise titanium, aluminum, and/or barium. These materials are preferred because it is desirable to have a more traditional white background that can be achieved with these materials. The most preferred metal oxide is titanium because of its superior whiteness. Typically it is important to control the thickness of the metal oxide coating to less than 120 nanometers to achieve a blue white appearance.

With nacreous pigments used in imaging application, it may be desirable to have non-uniform platelet thickness and small particles to create a white nacreous appearance. In imaging application where a different look is desirable, the use of thicker particles and more uniform spacing of platelets to each other creates a color interference that is more characteristic of mother-of-pearl. In general, the lustrous pigments referred to in this invention are pigments that consist of flat mica platelets coated with titanium dioxide or other metal oxides. They are irregular in shape and may vary in thickness from 0.1 to 0.5 micrometers, although some individual particles may be thicker. The particles may have a length of up to 500 micrometers. The coating applied to the mica particles should be controlled in thickness, but the overall thickness is one parameter that controls the overall color appearance. Each transparent coating helps to create the lustrous or pearlescent effect. The particle of these pigments influences the perceived texture of the pearl luster effect and adds a new dimension of beauty and quality to the image. The coating may be colored with other compatible transparent pigments and dyestuffs. The color seen is different than color pigments and dyes in that the color and lustrous iridescence is produced by light interference and not absorption or reflection of light. This is a surprisingly unique attribute to the field of silver halide photography. With the use of nacreous pigments there are many refractive interfaces that can produce a unique appearance to an imaging element. A light ray striking a layer containing nacreous platelets must pass through a substantially transparent layer of relatively lower refractive index binder polymer surrounding the platelet, and then the ray is then partially reflected by the metal oxide coating on the surface. The remaining part passes into the metal oxide coating layer and is again reflected as it exits the layer at the interface with the mica particle. Since the coating is very thin and the mica platelets are substantially transparent, the remaining light has many opportunities to be reflected at different angles. This helps to provide the lustrous nacreous appearance, as well as to add a three-dimensional quality to the image. The resulting color effect that is produced depends on the light reflection from the interfaces, as well as the type of coating on the mica particles. The multiple interfaces cause the reflected light to be slightly out of phase. It should also be noted that the color varies based on the angle of illumination and that an iridescence effect can be seen. Control of this effect is desirable depending on the effect that needs to be conveyed by the image. As noted above the thickness and type of the coating on the mica particles are factors that need to be considered. In addition the particle size can also be used to control the effect. For use in a photographic element it is desirable to have a smooth surface. To achieve this, a small particle is best but the layer thickness of the binder polymer in which the pigments are suspended may also be increased as well by applying clear overcoats. Larger particles used for nacreous effects above the image are not desirable because they can visually impact the image quality. The nacreous effect can be changed by adjusting the particle size, metal oxide coating thickness and type, as well as the concentration of the pigment. In general, low pigmentation levels are better at producing a three-dimensional effect. This effect may be enhanced by applying a thick clear layer over the top of the nacreous pigments. It should also be noted that different effects may be achieved by adding other transparent pigments and dyes in the layers. Since light sensitive photographic layers produce dye couplers that are semitransparent and typically do not contain pigment particles; they are uniquely positioned to be able to create synergistic effects with the nacreous pigments.

The nacreous pigments are relatively stable and generally resistant to alkali and acids, as well as high temperature. They can be dispersed in most carrying (binder polymer) media or compounded in thermoplastic resin and then extruded into sheets. Since the particles are substantially transparent, the use of a carrying media that is also transparent provides the maximum effect. If a more translucent carrying media is used, more nacreous pigment may be needed to achieve the same level of nacreous appearance.

In some applications it may be desirable to also have a nacreous pigment that is also conductive. Being able to provide a conductive path that helps to prevent the charge from building up is an important element for imaging media. This allows sheets to slide over each other and various equipment parts without static buildup or cling of one sheet to another. This type of pigment is also a means of adding conductivity to the emulsion side of a photographic element. Conductive nacreous pigments consist of an inter core of platelet mica that is coated with materials such as $TiO_2$, $SiO_2$ and further coated with an outer layer of dense layer of conductive, inorganic mixed metal oxide. A typical material is antimony-doped tin dioxide. The elongated particles of mica are useful in providing a conductive pathway when particles are touching.

The origin of the beauty of a genuine pearl has been well documented. It is known that its luster and color come from the multiple smooth concentric layers of nacre, i.e., calcium carbonate layer, organic constituent (conchiolin) layer. Each of these layers partially reflects and transmits light. Hence, a sense of depth and luster is observed in the reflection. Pigments that try to simulate the visual effect of a pearl are called pearlescent or nacreous pigments. The first nacreous pigment was the natural pearl. The commercial grades of nacreous pigments are made of thin transparent platelets of high refractive index. These pigments are so designed that multiple reflections and transmissions occur and, as a result, a sense of depth is obtained in the overall reflected image. The characteristics of the pigment determine whether color is produced by light interference (specifically called as interference pigments) or no color is produced (called as white nacreous pigments).

Some of the earliest pearlescent pigments were the plate-like bismuth oxychloride crystals, and basic lead carbonate. These pigments reflect light similar to a pearl essence crystal. Due to toxicity of lead, bismuth oxychloride (BiOCl) crystals have seen an increased use in the marketplace. BiOCl is generally crystallized from solution into smooth, thin platelets which has a particle size ranging from 5 micrometer to 15 micrometer.

The other commonly used pearlescent pigments are those made from mica coated with either titanium dioxide (U.S. Pat. No. 4,040,859), iron oxide (U.S. Pat. No. 3,087,829), zirconium dioxide (U.S. Pat. No. 3,087,828), or other high refractive index materials. Mica is used because it is transparent to light and can be cleaved into extremely thin flakes. Examples of mica suitable for pearlescent pigments are muscovite, paragonite, phlogopite, biotite, and lepidolite. The mica platelets are then coated with a thin single layer or multiple layers of high refractive index inorganic oxide. The reflection efficiency depends to a large extent on the refractive index difference between the mica platelet and the inorganic oxide coating. This layered structure enables it to function like a pearlescent pigment. The oxide coating provides the optical effects like luster, interference reflection color (if oxide coating is sufficiently thick) and absorption color (if the oxide contains color material). The size of the mica particle also plays an important role in determining the final reflected image. The weight of the mica in the pigment usually lies between 40% and 90% and most usually in the range of 60% and 80%. If titanium dioxide is used as the coating and its coating thickness is increased, then an iridescence effect (color) is observed. The dimensions of pearlescent pigments used in this invention may be between 5 micrometer and 400 micrometer and preferably between 5 micrometer and 100 micrometer because particles less than 5 micrometer are not very efficient in creating the nacreous appearance, while particles greater than 100 micrometer progressively get rougher. Excessive roughness on the surface tends to shut down the nacreous appearance. The thickness of the pigment is preferably between 0.1 micrometer and 0.6 micrometer and more preferably between 0.2 micrometer and 0.4 micrometer. Particles less than 5 micrometer or less than 0.2 micrometer typically do not have sufficiently higher nacreous appearance, while particles greater than 400 micrometer in length or 0.6 micrometer in width typically are very large and tend to create roughness which starts to shut down the nacreous effect.

Other optically variable pigments that are suitably used are silicon oxide coated with thin layers of aluminum (5 nanometer and 10 nanometer) or titanium dioxide, and magnesium fluoride crystals coated with chromium have also been used. These pigment structures have been highlighted in U.S. Pat. No. 3,438,796. New optically variable pigment structures based on coated platelet like metallic substrates have been disclosed in U.S. Pat. Nos. 5,364,467 and 5,662,738. 5,976,511 discloses pigments composed of barium sulfate particles and coated with zinc oxide, cerium oxide, or titanium dioxide which have a pearly luster.

The photographic elements of this invention may utilize an integral emulsion bonding layer that allows the emulsion to adhere to the support materials during manufacturing and wet processing of images without the need for expensive subbing coatings.

The terms as used herein, "top", "upper", "emulsion side", and "face" mean the side or toward the side of a photographic member bearing the imaging layers. The terms "bottom", "lower side", and "back" mean the side or toward the side of the photographic member opposite from the side bearing the photosensitive imaging layers or developed image. Nacreous appearance is a pearly, luster, iridescent, metallic sheen. A characteristic property of a nacreous appearance is an angular dependence of viewing angle.

Useful nacreous pigments comprises mica. Coated mica is preferred because it has a platelet structure that, when coated with metal oxides, has a nacreous appearance that provides a very unique look to an image that is appealing. Furthermore, said mica may be easily dispersed and coated in a layer or layers that comprise silver halide emulsion, as well as layers that are free of or at least substantially free of silver halide emulsion. For the purpose of this invention the term "mica" refers to nacreous materials and includes mica, feldspar, quartz, silicates, modified mica, and mica that has been coated with a metal oxide, mica coated with materials that have a difference in refractive index greater than 0.2. The mica material may be a translucent organic and/or inorganic materials and may have a nacreous effect when viewed from different angles.

It may also be useful to incorporate nacreous in either or both the light sensitive emulsion layers and the size overcoat. Nacreous pigments have been shown to be an effective means to filter UV radiation. This has significant advantage to minimize photographic dye fade.

When working with photographic elements comprising a nacreous pigment above the image it may also be useful to have the layer further comprises electrical resistant of less than $10^{13}$ log ohms per square. Electrical resistance less than $10^{13}$ is desirable to prevent static buildup and discharge that can cause the light sensitive layer to fog.

For both pigment and voiding methods, "white" nacreous luster is a function of the orientation, as well as the spacing and composition of the materials. The luster and depth appearance of the media are mainly due to the reflected light that reaches the eye. Both pigments and voids that provide a nacreous appearance function as platelets oriented parallel to each other. This results in depth as each platelet reflects some of the incident light while transmitting the rest. Any imperfections due to surface defects or platelet or void orientation misalignments will cause the light to be scattered in a non-specular direction, and will degrade the nacreous appearance of the material.

In addition, the natural tendency for randomness in regards to platelet or void alignment and spacing will render the media incapable of producing color by light interference. Any color produced by one alignment and spacing will have a tendency to be counteracted by other encountered alignments and spacing. However, gross geometric misalignments of the platelets or voids will also result in less than desirable functionality, and a method of measuring this defect is required as well.

FLOP is a test method used to measure the nacreous quality of materials of interest. 45-degree incident light is collected at 10, 45, and 110 degrees from the specular reflection angle. The spectrophotometric output, e.g., CIE L* (L1*, L2*, L3* respectively) is used as follows:

$$FLOP=15(L1^*-L3^*)^{1.11}/L2^{*0.86}$$

whereby FLOP values less than 10 have no nacreous appearance and FLOP values greater than 10 are indicative of a nacrescent appearance.

Furthermore, quality monitoring of these nacreous materials, when combined with one or more semitransparent color forming dyes layers, places limitations on the usefulness of measurements taken with typically found reflection densitometers having 0/45 geometry. This is due to the angular dependency of these media. This angular viewing dependency of the media and the inherent randomness of the structure will result in errors "reading out" the dye formed due to the variability of the media at any one collection angle. These highly specular and translucent materials will reflect some light in angular dependent non-specular directions as well. It has been found that although incident light and collection at 0/45 will allow for a prediction of density minimum versus FLOP, these values are no longer predictive, as density increases from density minimum to density maximum as color dye forming layers are added to the media.

This can be explained as a function of the dye density. As density increases, the ability for multiple reflections through the media decreases. As the reflection passes approach one, the nacreous look will no longer be apparent.

Spectrogoniometric measurements can be employed to measure the media at various angles, but spectrogoniometric readings are tedious and the apparatus is expensive. An alternative for quality monitoring purposes to assess the amount of color forming layers coated and subsequently processed would be useful. During a color photographic coating operation, the need to reduce inherent manufacturing variability of color forming coupler levels is required and this data collection by conventional reflection 0/45 densitometry is impeded by the natural variability found in the nacreous media. Slight changes in the reflective properties of the base media will result in more or less light reaching the densitometer which, in turn, can result in an erroneous readout of the formed dye.

One such method to provide correct assessment during a coating operation would be to remove the nacreous properties of the media. This can be accomplished by collecting light from the prepared sample at a grazing angle that would minimize the nacreous layer contributions. Diffuse 8 degree sphere optical geometry handheld spectrophotometers have been shown to meet this need.

In a preferred embodiment of this invention a photographic element comprises at least one layer containing nacreous pigment above the image. This embodiment is preferred because the nacreous pigment may be applied over the image after it has been formed. This provides an opportunity to add nacreous appearance to any image. This may include other imaging method other than photographic such as inkjet, thermal dye transfer or electrophotographic. In another preferred embodiment of this invention, said nacreous pigment comprises at least one member selected from the group consisting of metal oxide modified mica, feldspar, and quartz. These materials are preferred because they provide a unique appearance to the overcoat coat or laminate of the image. The most preferred metal oxide modified mica are those containing titanium, aluminum, or barium. These metal containing materials are desired for their compatibility with the thin plate-like mica. It should be noted that the overall concentration must be keep low some as not to obscure the image. In a preferred embodiment of this invention the nacreous pigment above the image should in present in the layer between 7 and 150 $mg/m^2$. Since the nacreous pigments are light scattering in nature, the amount of pigment may effect the image quality. Typically when nacreous pigments are below 7 $mg/M^2$ there is not a sufficient amount of pigment to create the nacreous appearance while levels above 150 $mg/m^2$ have excessive light scattering that may interfere with the viewing of the print. The actual particle size of the nacreous pigment may also play a role in the acceptable concentration. Smaller particle size nacreous are more desirable when used above the image layer because they tend to have less interference than large particles. The most preferred particles of this invention have a mean particle size of between 0.5 and 15 micrometers. Below 0.5 micrometers, the nacreous pigments have little or no nacreous effect. Above 15 micrometers the particle may cause excessive light scattering and interfere with the image.

In an additional embodiment said nacreous layer above the image provides scratch resistances greater than 3 grams. One means of providing resistant to scratches is to apply an overlaminated transparent polymer sheet containing a nacreous pigment to the surface of the photographic element of this invention. In this embodiment any suitable polymer sheet may be used such as polyester, polyolefin, polycarbonate, or polyamide. In the most preferred embodiment the sheet comprises polycarbonate which may be further provided with a textured surface. Polycarbonate is highly desirable because it is a tough polymer sheet and offers superior scratch resistance. The scratch resistant polymer sheet has a scratch resistance of greater than 3 grams. The scratch data was determined by applying a 1500 g ramped load force at a velocity of 10 mm/min. with a 54 micrometer radius, 120 degree conical Rockwell Diamond stylus. The scratch length was 10 mm. The samples were then examined visually for the presence of a scratch. This is preferred because it offers a wide range in scratch resistance and improved durability of prior practices. Other polymers and additives that may be added to the upper surface of the overlaminate to enhance their scratch resistances include polyurethanes, polyesters, epoxies, and other polymers disclosed above. Various hard filler particles may be used in these polymers such as pigments, silica, silicates, and glass beads. The use of texture with a roughness average of 50 to 250 is also useful in minimizing fingerprinting but excessive texturing may significantly reduce or eliminate the nacreous appearance.

In an additional embodiment of this invention said photographic element has a resistance to staining agents of greater than 5 minutes. Images are often subjected to handling abuses. Staining agents may include liquid spills of a variety of materials such as water, milk, coffee, soda pop, tea, ketchup, grease, oils. Resistance to staining agents refers to the ability of the image to withstand or holdout the staining agent from the surface of the photographic element for a defined period of time. Handling abuses may also include fingerprints oils, dirt and other materials that may damage the image. An assessment of the materials resistance to staining may be evaluated by placing a drop of the staining agent (approximately 1 milliliter) on the upper surface of the overcoat or over-laminate. The material is left in contact with the surface at room temperature for 5 minutes and then removed by removing the residual initially with a dry absorbent tissue and then using a damp tissue to gentle wipe the surface. The surface is then examined for any change in color or staining. For purposes of this invention the resistance to staining agents of greater than 5 minutes refers to resistance to water and also resistance to yellow mustard containing turmeric.

In a preferred embodiment of this invention nacreous containing layer above the image may comprises at least one member selected from the group consisting of comprises polyurethane, polyester, acrylic, vinyl, polycarbonates, acrylate latexes and copolymer derivatives thereof, carnauba wax, and/or fluoro-containing materials. These material are preferred because they may provide protection of the image from staining agents and may also provide a degree of scratch resistances by using a tough polymer binder that holds the nacreous pigment and or providing a sufficient sliding friction to minimize scratches.

In a further preferred embodiment of this invention said at least one layer comprising nacreous pigment above the image comprises a biaxially oriented polymer sheet. The biaxially oriented sheet provides a high level of toughness to the surface as well as protection of the image from a variety of environmental and handling hazards. The biaxially oriented polymer sheet comprises a polymer selected from the group consisting of polyolefin, polyester, polyamide, polycarbonate and copolymers thereof. The thickness of the preferred biaxially oriented polymer sheet may be between 6 and 100 micrometers. Biaxially oriented polymer sheets below 6 micrometers are very thin and are difficult to apply to the image surface without wrinkles and buckles. Sheet above 100 micrometers may be used but are not preferred because they provide little additional value to the photographic element for the added expense. Furthermore if the sheet becomes too stiff, problems may occur in applying it to the image surface.

In the formation of the above described biaxially oriented polymer sheet, a metal oxide coated mica is compounded into the plastic polymer and then melt extruded on a casting wheel or moving band, quenched and stretched in the machine direction and then in the cross direction. The material may be further heat relaxed to provide additional dimensional stability. When adding these materials to the plastic, the level should be kept low to prevent voiding of the layer.

In an additional embodiment of this invention the biaxially oriented polymer sheet above the image provides fingerprint resistances. Photographic images as well as other imaging prints are handled and it is very easy to soil or mark the surface with fingerprint oils. These oils are typically absorbed onto the gelatin surface of photographs or even on the surface of polymer overlaminates. Even plastic surface can be damaged by scratches when fingerprint oils are wiped with a tissue. One means to obtain fingerprint resistance is to provide a surface roughness of between 0.01 and 0.06 micrometers at a spatial frequency of between 0.03 and 6.35 millimeters. Such a roughness pattern breaks up the fingerprint pattern and make it less noticeable. To achieve surface roughness at these levels it is necessary to have the nacreous pigment in a lower layer.

A preferred means to control fingerprinting and other handling issues is to provide at least one polymer selected from the group consisting of polyurethane, polyester, acrylic, vinyl, polycarbonates, acrylate latexes and copolymer derivatives thereof, carnauba wax, and/or fluoro-containing materials in the upper most layer above the image. These materials are preferred because they provide a tough durable layer that is abrasion and fingerprint resistant and they can be formulated to provide a clear layer with the required functionality need in the layer. This may include conductivity, abrasion resistances, resistances to staining agents, fingerprint resistances as well as a polymer carrier/binder layer for nacreous pigments. Of these materials, polyurethane is the most preferred polymer because of it easy of formulation and apply to the image or to a polymer sheet used as an over-laminate. In an additional embodiment of this invention the above stated polymers may be used in combination with nacreous pigments. Since these materials are typically clear, they do not compete with the nacreous pigment and therefore allows the maximum effect. Furthermore the nacreous pigments are readily dispersed in these polymers.

In an additional embodiment of this invention the layer above the image may contain an ultraviolet curable polymer or a crosslinking polymer. Such polymers when cured or crosslinked help to provide a hardened surface the is resistant to many handling and environmental problems. Useful polymer include acrylic, polyamide, polyester, acrylate, polyester, epoxies and polyurethane resins. Other useful addenda may include an ultraviolet light absorber or stabilizer selected from the group consisting of benzophenones and diphenyl acrylates. These materials are desirable because they provide excellent protection from degradation and help assure that the polymers do significantly degrade or yellow over the useful life of the product. Furthermore, the ultraviolet protection absorbers help to protect the image dyes of the photographic element.

To further enhance the effect of the nacreous pigment above the image, another embodiment is to additional provide at least one nacreous pigment below the image. This may be accomplished by having the nacreous pigment in the image layer or on or near the upper most layer of the support substrate. The combination effect of two or more nacreous pigments in an imaging element is desirable to enhance the nacreous effect. It also provides for the use of different pigments. In a preferred embodiment of this invention the photographic element not only has a nacreous pigment above the image but a layer comprising voids below the image. It has been shown that the use of voids in the base provides a unique look to the image. When this is done in combination with a nacreous pigment above the image, a surprisingly unique appearance is achieved that is highly valued in certain applications.

In an a preferred embodiment of this invention a process of forming a photographic element containing a photographic element with a developed image and adhering to the surface of said photographic element at least one layer comprising nacreous pigment. This embodiment is preferred because it provides a means to make an image into a nacreous image without having to expose through the nacreous pigment. Using this method, sharper image under the nacreous pigment is achieved.

In a further embodiment of this invention of the process described above further utilizes a biaxially oriented polymer sheet, containing nacreous pigment, comprising a polymer selected from the group consisting of polyolefin, polyester, polyamide, polycarbonate and copolymers thereof. These materials are desirable for their toughness and durability. Since the biaxially oriented sheet is adhered to at least one side of the photographic element, there should also be an adhesive present. This may be a pressure sensitive adhesive that is applied at or near room temperature or a heat activated adhesive.

In an additional embodiment of this process in which a nacreous layer is adhered to an imaged photographic element or otherwise formed imaging member further, said element is further folded to form an album page. This may be accomplished by an apparatus for making an album leaf from an image bearing sheet having an image bearing side and a non-image bearing side, comprising:

- a mechanism for folding said sheet about a fold line into a semi-folded position such that said image bearing side is facing outward;
- a mechanism for inserting an adhesive sheet within said semi-folded sheet;
- a mechanism for completing the folding of said semi-folded sheet so as to form an album leaf.

Furthermore it should be noted that the album page may be formed in the above apparatus and then an overwrap of laminate with a nacreous pigment adhered to the image sides. This method may also include providing a nacreous shrink wrap that encases the entire album page.

The preferred photographic elements of the present invention can be simple black-and-white or monochrome elements comprising a support bearing a layer of light-sensitive silver halide emulsion, or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

The light-sensitive silver halide emulsions employed in the photographic elements of this invention can include coarse, regular, or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions, although other hydrophilic colloids can be used in accordance with usual practice. Details regarding the silver halide emulsions are contained in and described in *Research Disclosure*, September 1994, Item 36544, Section I, published by Kenneth Mason Publications, Ltd., Dudley Annex, 12a North Street, Emsworth, Hampshire PO10 7DQ, ENGLAND as well as *Research Disclosure*, Item 36544, September 1994, and the references listed therein, as well as *Research Disclosure*, September 2000, Item 437013, published by Kenneth Mason Publications, Ltd., Dudley Annex, 12a North Street, Emsworth, Hampshire PO10 7DQ, ENGLAND.

The photographic silver halide emulsions utilized in this invention can contain other addenda conventional in the photographic art. Useful addenda are described, for example, in *Research Disclosure*, Item 36544, September 1994, and *Research Disclosure*, September 2000, Item 437013, published by Kenneth Mason Publications, Ltd., Dudley Annex, 12a North Street, Emsworth, Hampshire PO10 7DQ, ENGLAND. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

The invention has numerous advantages over the prior art. These and other advantages will be apparent from the detailed description below.

The following examples illustrate the practice of this invention. They are not intended to be exhaustive of all possible variations of the invention. Parts and percentages are by weight unless otherwise indicated.

EXAMPLES

Example 1

TABLE 1

| |
|---|
| L1: Transparent polyolefin laminate with nacreous pigment |
| L2: Color photographic imaged layer |
| L3: Low Density Polyethylene with 12% Rutile $TiO_2$ |
| L4: Photographic paper base |
| L5: Medium Density polyethylene |
| L6: Conductive layer |
| L7: Transparent polyolefin laminate |

Table 1 is a representation of an imaging element with a nacreous pigment applied as a overlaminate to an already developed image. L1 may be any typical transparent polyolefin overlaminate in which a nacreous pigment (Afflair 110 from EM industries) has been added. The overlaminate is a cast polyethylene sheet of approximately 2 mils with 1% by weight Afflair 100 (a nacreous pigment from EM Industries, where the mica particle size ranged from 10 micrometer–60 micrometer, and the titanium dioxide coating on mica platelets was anatase). The nacreous pigment was compounded into the polymer with a laboratory twin screw compounder. Although not shown in table 1 is a heat activated polyethylene acrylic copolymer adhesive that is adhered top surface of the image layer. L2 is a typical 3 color (although any photographic emulsion system may be used) as disclosed in described in *Research Disclosure*, September 1994, Item 36544, Section I, published by Kenneth Mason Publications, Ltd., Dudley Annex, 12a North Street, Emsworth, Hampshire PO10 7DQ, ENGLAND. Prior to the application of the nacreous overlaminate, the light sensitive layer was exposed and developed to form an image. The photographic emulsion was coated on a conventional resin coated photographic support. The rawbase was made using a standard fourdrinier paper machine utilizing a blend of mostly bleached hardwood Kraft fibers. The fiber ratio consisted primarily of bleached poplar (38%) and maple/beech (37%) with lesser amounts of birch (18%) and softwood (7%). Acid sizing chemical addenda, utilized on a dry weight basis, included an aluminum stearate size at 0.85% addition, polyaminoamide epichlorhydrin at 0.68% addition, and polyacrylamide resin at 0.24% addition. Titanium dioxide filler was used at 0.60% addition. Surface sizing using hydroxyethylated starch and sodium bicarbonate was also employed. This rawbase (L4) was then extrusion coated using a face side composite (L3) comprising substantially 83% LDPE, 12.5% titanium dioxide, 3% Zinc Oxide and 0.5% of calcium stearate and a wire side HDPE/LDPE blend at a 46/54 ratio (L5). Face and wire side resin coverages were approximately 25.88 g/m$^2$, and 27.83 g/m$^2$ respectively. An antistat layer (L6) was also applied to the backside resin. The bottom most layer L7 was a transparent polyethylene laminate with a heat activated adhesive as describe above. The adhesive was adjacent to the conductive layer.

Example 2

TABLE 2

| |
|---|
| Transparent polyolefin laminate with nacreous pigment |
| 3 color photographic imaged layer |
| Nacreous layer in gelatine |
| Low Density Polyethylene with 12% Rutile $TiO_2$ |
| Photographic paper base |
| Medium Density polyethylene |
| Conductive layer |
| Transparent polyolefin laminate |

The example describe in Table 2 is the same as Table 1 except there is an additional coated nacreous layer on the top polyethylene layer of the resin coated paper base. The nacreous pigment used was Afflair 110, a fine particle blue white pigment supplied by EM Industries, Inc. The pigment was dispersed in gelatin using typical mixing. The gel lay down was approximately 39 g/m$^2$, and the pigment weight was coated at 19.4 g/m$^2$. The coating layer was dried and then an image was exposed and developed using RA-4 chemistry. A nacreous overlaminate as described above was applied over the image and a transparent laminate applied to the backside.

This example represents a combination of nacreous pigment as an overlaminated and under the image layer.

Example 3

TABLE 3

| |
|---|
| Transparent polyolefin laminate with nacreous pigment |
| 3 color photographic imaged layer |
| Voided biaxially oriented polyolefin sheet |
| Low density polyethylene |
| Photographic paper base |
| Medium Density polyethylene |
| Low density polyethylene |
| Conductive layer |
| Transparent polyolefin laminate |

Example 3 utilizes the same transparent polyolefin laminate with nacreous pigment and the same imaged photographic layer as in example 1 and 2. The difference is that the photographic layers have been coated on a 5 layer biaxially oriented sheet. This sheet has a transparent polyethylene layer that is 5 micrometer thick on top of a 12 micrometer clear layer of polypropylene that further contains 0.15% by weight of Hostulax KS optical brightener. This layer is on top of a voided 20 micrometer thick voided layer of polypropylene that has been voided using a void initiating agent of polybutylene terephthalate. The voids are formed when the cast sheet is stretch in a ratio of 5 times n the machine direction and 8 times in the cross machine direction. The voided layer is on top of a 12 micrometer thick layer of polypropylene that contains 18% by weight of Dupont Rutile 101 on a bottom most layer of 5 micrometer thick clear polypropylene.

Example 4

Control

TABLE 4

| |
|---|
| L1: Transparent polyolefin laminate |
| L2: Color photographic imaged layer |
| L3: Low Density Polyethylene with 12% Rutile $TiO_2$ |
| L4: Photographic paper base |
| L5: Medium Density polyethylene |
| L6: Conductive layer |
| L7: Transparent polyolefin laminate |

The control sample is a photographic image on resin coated paper that has been overlaminated with a clear non-nacreous film. It is the same as example 1 expect that there is no nacreous pigment in the structure.

TABLE 5

| Example | Nacreous Appearance |
|---|---|
| 1 | Yes |
| 2 | Yes |
| 3 | Yes |
| 4 (Control) | No |

As can be seen in Table 5, examples 1,2 and 3 that contain nacreous pigment in the top most film laminate exhibit the nacreous effect. It should be noted that the example 2 and 3 also contain a nacreous pigment below the image layer. Example 4 is the control sample that contains no nacreous pigment and does not have the nacreous effect.

The invention has been described in detail with particular reference to certain preferred embodiments thereof, but it will be understood that variations and modifications can be effected within the spirit and scope of the invention.

What is claimed is:

1. A photographic element comprising at least one layer comprising nacreous pigment above the upper side of said image, and wherein said at least one layer comprising nacreous pigment above the image comprises a biaxially oriented polymer sheet.

2. A photographic element of claim 1 wherein said photographic element has a resistance to scratching greater than 3 grams.

3. A photographic element of claim 1 wherein said photographic element has a resistance to staining agents of greater than 5 minutes.

4. A photographic element of claim 1 wherein said at least one layer comprising nacreous pigment comprises at least one member selected from the group consisting of metal oxide modified mica, feldspar, and quartz.

5. The nacreous pigment of claim 4 wherein preferred said metal oxide modified mica further comprises titanium, aluminum, or barium.

6. The photographic element of claim 1 wherein said nacreous pigment has a mean particle size between 0.5 and 15 micrometers.

7. A photographic element of claim 1 wherein said biaxially oriented polymer sheet comprises a polymer selected from the group consisting of polyolefin, polyester, polyamide, polycarbonate and copolymers thereof.

8. A photographic element of claim 1 wherein said at least one layer comprising nacreous pigment comprises a substantially transparent biaxially oriented polymer sheet with a thickness between 6 and 100 micrometers.

9. The photographic element of claim 1 wherein said biaxially oriented polymer sheet further comprises fingerprint resistance.

10. The photographic element of claim 9 wherein said fingerprint resistance comprises a surface roughness of between 0.01 and 0.06 micrometers at a spatial frequency of between 0.03 and 6.35 millimeters.

11. The photographic element of claim 1 wherein said at least one layer comprising nacreous pigment above the image further comprises at least one polymer selected from the group consisting of polyurethane, polyester, acrylic, polycarbonates, acrylate latexes and copolymer derivatives thereof, carnauba wax, and/or fluoro-containing materials.

12. The photographic element of claim 1 wherein said biaxially oriented sheet further comprises a layer of polyurethane in the upper most part.

13. The photographic element of claim 11 wherein said polymer comprises an ultraviolet curable polymer.

14. The photographic element of claim 1 containing said at least one layer of nacreous pigment above the image further comprises at least one layer of nacreous pigment below said image.

15. The photographic element of claim 1 containing said at least one layer of nacreous pigment above the image further comprises at least one layer of voids below said image.

16. The photographic element of claim 1 wherein said nacreous pigment is present in the amount between 7 and 150 $mg/m^2$.

17. A photographic element comprising at least one layer comprising nacreous pigment above the upper side of said image and comprising at least one layer of voids below said image.

18. A photographic element of claim 17 wherein said photographic element has a resistance to scratching greater than 3 grams.

19. A photographic element of claim 17 wherein said photographic element has a resistance to staining agents of greater than 5 minutes.

20. A photographic element of claim 17 wherein said at least one layer comprising nacreous pigment comprises at least one member selected from the group consisting of metal oxide modified mica, feldspar, and quartz.

21. The nacreous pigment of claim 20 wherein preferred said metal oxide modified mica further comprises titanium, aluminum, or barium.

22. A photographic element of claim 17 wherein said at least on layer comprising nacreous pigment comprises a substantially transparent biaxially oriented polymer sheet with a thickness between 6 and 100 micrometers.

23. A photographic element of claim 22 wherein said at least one layer comprising nacreous pigment above the image comprises a biaxially oriented polymer sheet.

24. A photographic element of claim 23 wherein said biaxially oriented polymer sheet comprises a polymer selected from the group consisting of polyolefin, polyester, polyamide, polycarbonate and copolymers thereof.

25. The photographic element of claim 23 wherein said biaxially oriented polymer sheet further comprises fingerprint resistance.

26. The photographic element of claim 25 wherein said fingerprint resistance comprises a surface roughness of between 0.01 and 0.06 micrometers at a spatial frequency of between 0.03 and 6.35 millimeters.

27. The photographic element of claim 23 wherein said biaxially oriented sheet further comprises a layer of polyurethane in the upper most part.

28. The photographic element of claim 17 containing said at least one layer of nacreous pigment above the image further comprises at least one layer of nacreous pigment below said image.

29. The photographic element of claim 17 wherein said nacreous pigment is present in the amount between 7 and 150 $mg/m^2$.

30. The photographic element of claim 17 wherein said nacreous pigment has a mean particle size between 0.5 and 15 micrometers.

* * * * *